United States Patent [19]

Dilger et al.

[11] 4,338,900

[45] Jul. 13, 1982

[54] FUEL METERING APPARATUS IN AN INTERNAL COMBUSTION ENGINE

[75] Inventors: Peter Dilger, Neuried; Günter Hönig, Ditzingen; Helmut Kauff, Schwieberdingen, all of Fed. Rep. of Germany

[73] Assignee: Robert Bosch GmbH, Stuttgart, Fed. Rep. of Germany

[21] Appl. No.: 148,434

[22] Filed: May 9, 1980

[30] Foreign Application Priority Data

May 12, 1979 [DE] Fed. Rep. of Germany ..... 2919194

[51] Int. Cl.[3] ..... F02B 3/00

[52] U.S. Cl. ..... 123/440; 123/489

[58] Field of Search ..... 123/440, 489

[56] References Cited

U.S. PATENT DOCUMENTS

| | | | |
|---|---|---|---|
| 4,178,793 | 12/1979 | Bremer | 123/440 |
| 4,214,563 | 12/1978 | Hosaka | 123/440 |
| 4,226,221 | 10/1980 | Asano | 123/440 |
| 4,237,839 | 12/1980 | Ueno | 123/440 |

*Primary Examiner*—Ronald B. Cox

*Attorney, Agent, or Firm*—Edwin E. Greigg

[57] ABSTRACT

A fuel metering apparatus in an internal combustion engine is proposed, in which the metering signal is correctable in accordance with the mixture composition and/or the exhaust gas composition, this composition is detected by means of a sensor for at least one component of the mixture and/or exhaust gas, and the sensor signal proceeds to a single threshold switch for evaluation. The output level of the threshold switch is monitored in its course and the correction signal as well as an error recognition signal are derived from it.

20 Claims, 4 Drawing Figures

V a)
$V_m = V_2$
$V_R$
$V_2 - V_R$
a
b
c
d
e
f'
f
g
RICH
t
b)
$V_m$
c)
$V_o$
d)
e)
f)
g)
a
b
c
d
e
f
g
h)
i)

ERROR INDICATOR
ADDER
VALVE
57
tiλ
FUEL METERING CIRCUIT
55
56
MULTIPLY
54
ti
SIGNAL GENERATOR
53
AIR FLOW
R.P.M.
65
63
64
72
74
FF6
69
D E
71
66
67
C
MEMORY
70
COMPARATOR
51
50
UP/DN COUNTER
CLOCK INPUT
52
ADDER
SET VALUE
A
60
61
62
75
MULTIPLY
77
78
SET VALUE
79
80
B
CLOCK INPUT

FUEL METERING APPARATUS IN AN INTERNAL COMBUSTION ENGINE

BACKGROUND OF THE INVENTION

The invention relates to a fuel metering apparatus in an internal combustion engine. It is generally known to make the fuel metering signal, intended for injection valves, for instance, dependent on the exhaust gas composition. See U.S. Pat. No. 3,745,768 to Zechnall. To this end, the oxygen component of the exhaust gas is detected by a sensor and evaluated for the purpose of regulating the mixture composition. Oxygen sensors, however, are not failsafe, so monitoring devices must be provided. For example, the impulse of the output signal in the lambda sensor, or oxygen sensor, becomes flatter with increased operating time, which is detrimental to the reaction time of the apparatus controlling the mixture composition.

A monitoring device for an oxygen sensor is already known which has two threshold switches which, during the transition of the mixture (a transition from rich to lean, for example), detects the dwell time of the sensor output signal in a predetermined middle range and evaluates the signal to recognize an error. See U.S. Pat. No. 4,208,993 to Peter. Not only does this involve increased expense, but the use of two comparators has proved to be not suitable for safety reasons.

OBJECT AND SUMMARY OF THE INVENTION

An object of the invention is to provide a fuel metering apparatus that offers the desired and necessary degree of safety and reliability, using one threshold switch.

A second object is the metering of fuel between rich and lean mixtures, limited by two predetermined threshold values.

The lambda sensor is positioned in the exhaust manifold of an internal combustion engine to sense gas composition. A detection of a low concentration of oxygen in the exhaust gas indicates a rich fuel mixture in the intake manifold. Accordingly, the fuel metering device is directed to provide a less-rich mixture to the fuel injection valves. If the fuel metering device over-compensates by providing a too-lean mixture, the lambda sensor will detect a high concentration of oxygen in the exhaust gas. The fuel metering device is then directed to provide a greater fuel-to-air ratio. It can be seen that the signal generated by the sensor fluctuates as the mixture changes.

Two threshold values are then chosen to define the region in which an optimal fuel mixture is delivered to the engine. These two threshold levels are generated by a single switch. This is accomplished by alternately biasing the switch between high and low values, thus generating two voltage output levels.

If the signal exceeds the upper threshold value, indicating a too rich mixture, a command is generated to curtail the duration of normal fuel injection signal $t_i$. The fuel injection signals are prolonged, however, if the sensor signal falls below the lower threshold. When the sensor signal falls between the threshold values, the fuel injection signals are generated at their normal duration, thus allowing fuel and air to flow at a balanced amount and normal rate.

As a result of the features disclosed, advantageous further embodiments of and improvements to the fuel metering apparatus are possible. Thus, the correction of the mixture composition can be effected in fine gradations using the signal which is available at the output of the threshold switch, and if need be a switchover can be made from closed-loop to open-loop control and an error indication can be made.

The invention will be better understood and further objects and advantages thereof will become more apparent from the ensuing detailed description of a preferred embodiment taken in conjunction with the drawings.

DESCRIPTION OF THE PREFERRED EMBODIMENT

FIG. 1*a* shows the output signal of a lambda sensor in the exhaust manifold of an internal combustion engine where the gas composition or fuel-to-air ratio is changing. A high voltage value can be seen at the outset, indicating a rich mixture in the intake manifold, which is associated with a very low concentration of oxygen, or none at all, in the exhaust gas. Depending on the course of the curve, the fuel metering is directed more or less briefly into a less-rich range, in order to make a transition subsequently to the lean side. A renewed enrichment follows, then a renewed leaning down, and finally there is a simulation of a sensor failure and thus a constant sensor voltage in the middle range. It is true that errors in the sensor itself and in the subsequent sensor circuitry, which permit the sensor output signal to run to a lower or upper threshold value, are also possible; however, these errors are detected by another circuit layout, not shown, or under the control of a computer.

Given a fully intact sensor, there is a relatively steep voltage jump upon transition from the rich range into the lean range or vice versa. Especially in sensors which have been in service for many hours, these transitions become obliterated, so that it is not possible to sufficiently regulate mixture ratios. This deterioration in the functioning of a sensor is now detected by measurement of the dwell time of the sensor output signal in a predetermined range of values. In the present fuel metering apparatus, the sensor output signal is compared with two voltage thresholds (dashed lines in FIG. 1*a*) and the variation of the threshold output signal is detected.

Figure 1:
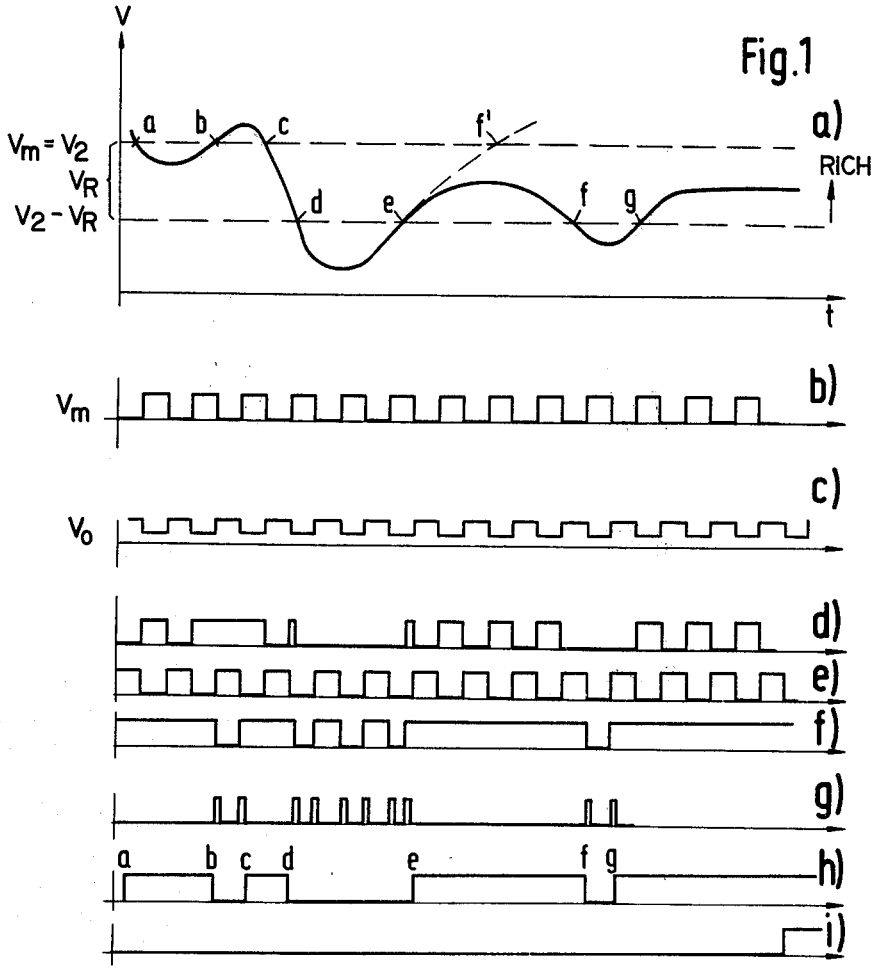
FIGS. 1*a*–1*i* show the course taken by the sensor output signals as well as individual points of the circuit layout following the threshold switch.
Figure 2A:
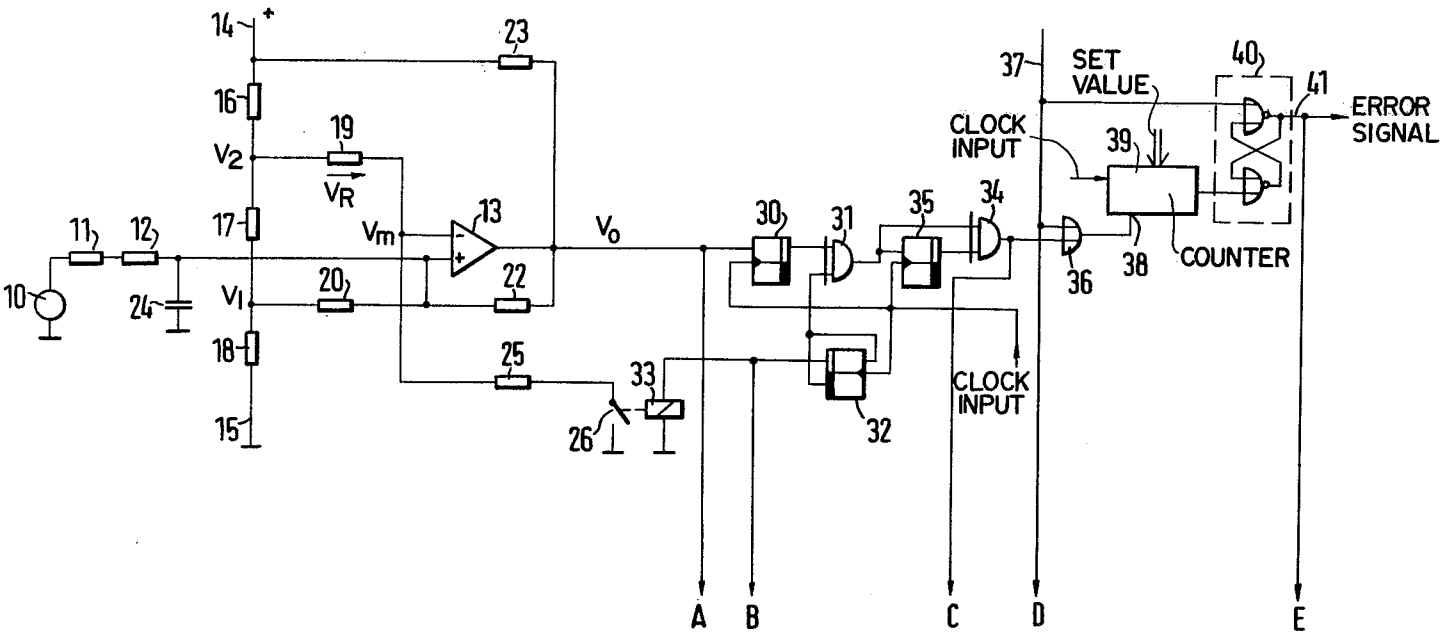
FIGS. 2*a* and 2*b* are circuit diagrams of the electrical portion of the fuel metering apparatus.

The remaining signal courses shown in FIG. 1 pertain to individual points of the circuit apparatus of FIG. 2*a*, which shows the sensor and the associated sensor signal evaluation circuit.

In FIG. 2*a*, a lambda sensor 10 is shown, which is connected by one terminal directly to ground and is connected with the other terminal (symbolically) via the inner resistor 11 of the sensor and a series resistor 12 to the positive input of a differential amplifier 13. Between a positive terminal 14 and the ground line 15, there is a voltage divider comprising three resistors 16, 17 and 18. While the junction of the two resistors 16 and 17 is connected via a resistor 19 to the negative input of the differential amplifier 13, the junction of the two resistors 17 and 18 is connected via a resistor 20 to the positive input. The differential amplifier 13 is coupled therewith via a resistor 22, and there is a further resistor 23 located between the output of this amplifier 13 and the positive line 14. In order to suppress interference, a capacitor 24 is further disposed between the positive input of the amplifier 13 and ground. The switching threshold of the amplifier is alternated between high and low voltage values via the negative input, from whence a series circuit comprising resistor 25 and switch 26 is connected to ground.

A D-flip-flop 30 is disposed after the output of the amplifier 13 and its Q output is connected to a first input of an exclusive OR gate 31. The second input of this gate 31 can be exposed to the output signal of the inverting output of a further D-flip-flop 32, whose output level can be alternated between high and low in the rhythm of a clock frequency provided by an oscillator (not shown). The Q output of this flip-flop 32 is carried to a relay 33 of the switch 26.

The exclusive OR gate 31 is followed by a further exclusive OR gate 34, the two inputs of which can be exposed to the output signal of the exclusive OR gate 31, one of them directly and the other via a D-flip-flop 35. On the output side, the exclusive OR gate 34 is connected to the first input of an OR gate 36. This OR gate 36 is connected via its second input to a reset line 37 and is connected with its output to a charge input 38 of a counter 39. The counter 39 is clocked by an oscillator and its overflow controls a flip-flop 40, which can also be reset with a signal from the reset line 37. An error signal is generated at the output 41 of the flip-flop 40, if the sensor signal remains for too long a time in the range between the two thresholds that are represented by dashed lines in FIG. 1*a*.

In FIG. 2*a*, six lines with arrows at the ends are also shown, carrying the letters A through E. Terminal A is connected to the output of the differential amplifier 13, terminal B with the Q output of the flip-flop 32. Letter C indicates a line from the output of the exclusive OR gate 34, D indicates the reset line 37, and finally E is a terminal connected to the output of the flip-flop 40.

The mode of operation of the circuit layout of FIG. 2*a* will now be explained, with the aid of the diagrams given in FIGS. 1*a* through 1*i*.

While FIG. 1*a* shows the output signal of the sensor 10, FIG. 1*b* shows the output signal at the Q output of the flip-flop 32. Because this signal permits the switch 26 to change from one position into the other, a direct current of varying levels results at the negative input of the differential amplifier 13, as shown in FIG. 1*c*. On the basis of this input signal at the negative input of the differential amplifier 13, the input signal shown in FIG. 1*a* is called up with a varying threshold, and the result is the output signal of the amplifier 13 shown in FIG. 1*d*. It can be seen that there is a periodically changing output signal for as long a time as the sensor signal voltage is in the range between the two thresholds, marked with broken lines, of FIG. 1*a*. If the sensor signal exceeds the upper threshold, as is shown by way of example in FIG. 1*a* between times b and c, then the input signal to amplifier 13 is at a high value, independently of the particular threshold value. Conversely, there is no change in the output signal of the differential amplifier 13 whenever the sensor signal is below the lower threshold. The difference is that when the sensor output signal is high the differential amplifier output signal also has a high value, while with a low sensor output level the output voltage of the differential amplifier is zero as well.

The flip-flop 30 disposed subsequent to the differential amplifier 13 serves the purpose of resolution and thus of synchronization of the amplifier output signal, as determined by the clocked input to flip-flop 30. FIG. 1*e*shows the signal at the inverting output $\overline{Q}$ of the flip-flop 32. The positional recognition of the sensor output signal relative to the threshold values (see FIG. 1*a*) takes place in the exclusive OR gate 31, whose output signal is shown in FIG. 1*f*. The combination which follows this gate 31, made up of the flip-flop 35 and the exclusive OR gate 34, serves to recognize edges in the output signal of the exclusive OR gate 31. The counter 39 is set with a predetermined value and is charged again and again with the output signal of the exclusive OR gate 34 as shown in FIG. 1*g*. Therefore, a counting process of relatively long duration occurs only during pauses of relatively long duration in the signal of FIG. 1*g*. This is shown in FIG. 1*h*, wherein the brief counting processes based on the outset value are not shown for purposes of clarity; instead, only those counting processes are shown which occur during relatively long pulse pauses in the signal of FIG. 1*g*. Depending on the selected outset value, an overflow occurs during these counting processes after a relatively short or long period, and this overflow can be interpreted as an error event. An example of this is shown in FIG. 1*i*.

The curve course of FIG. 1*d* permits one to determine, on the basis thereof, the position of the sensor signal with respect to the two threshold values, for with a sensor signal above the upper threshold there is "continuous operation" at a high voltage level; with a sensor signal between the two threshold values, there is pulsed operation; and if the sensor signal voltage is below the lower threshold, then the output voltage of the differential amplifier 13 of FIG. 2*a* is at zero. This signal of FIG. 1*d* can now be utilized for the purpose of mixture regulation, for which purpose the circuit layout of FIG. 2*b* is intended.

Figure 2B:
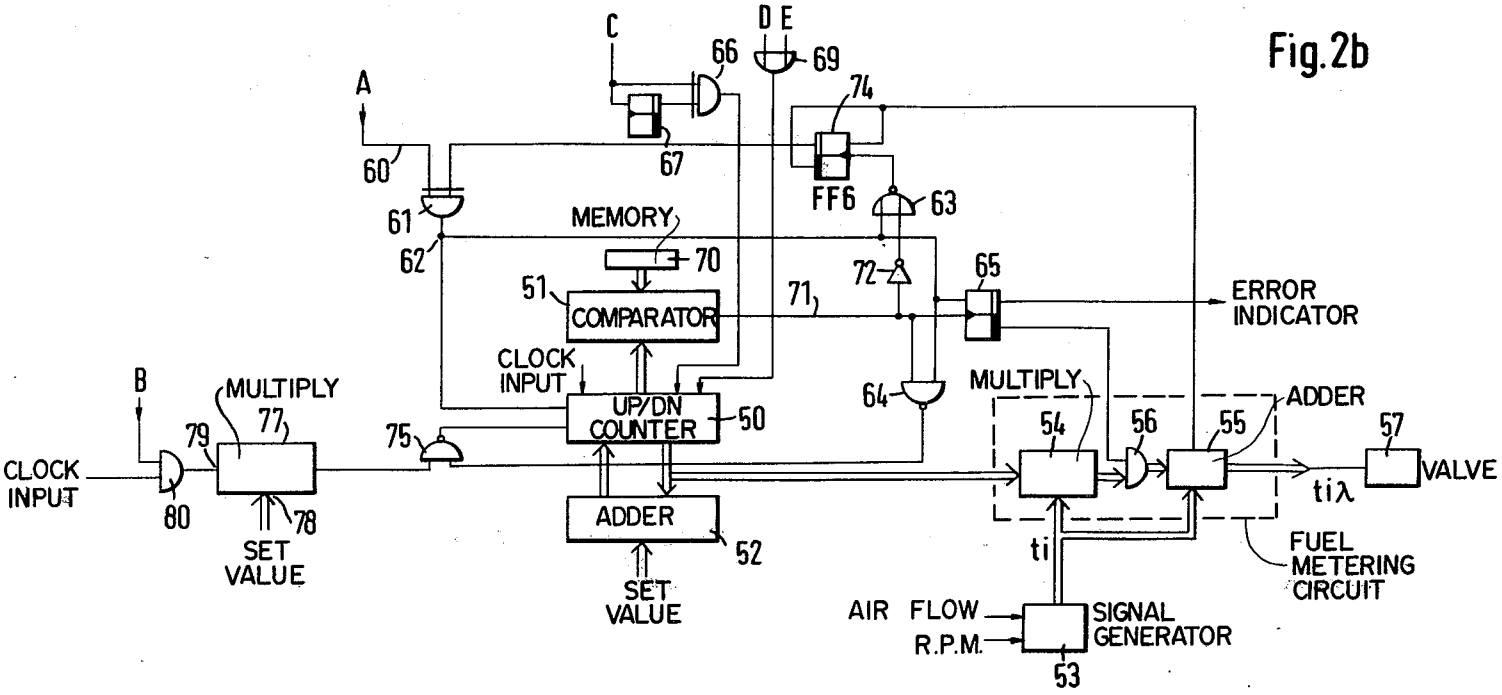

The primary component of the subject of FIG. 2*b* is an up-down counter 50 in combination with a comparator 51 and an adder 52. A signal generator circuit 53 furnishes an output signal of standard length $t_i$ as the injection time in a fuel metering system, based at least on the operating characteristics of rpm and air-flow in the intake manifold. This injection signal, which has not yet been corrected in terms of exhaust gas composition, is delivered both to a fuel metering circuit, comprised of a multiplier circuit 54, (Intel 7497), AND gate 56 and an adder circuit 55, with the multiplier circuit 54 being linked in turn via an AND gate 56 with a further input of the adder circuit 55. On the output side, a corrected injection signal can be picked up from this adder circuit 55 and finally delivered to an injection valve 57.

In its details, the subject of FIG. 2*b* has the following circuit layout. From circuit point A, a line 60 leads to the first input of an exclusive OR gate 61, whose output is connected to a branching point 62. From point 62, lines lead to the counting input of the up-down counter 50, to one input of a NOR gate 63, to a NAND gate 64 and to the input of a flip-flop 65. A signal from the output of an exclusive OR gate 66 is present at the charge input of the counter 50, and the inputs of the exclusive OR gate 66 are connected, first, directly with terminal point C and then, indirectly, via a D-flip-flop 67 with terminal point C.

Preceding the reset input of the counter 50 is an OR gate 69, whose inputs are coupled with the circuit points D and E; that is, they are connected to the reset line 37 and output 41 of the flip-flop 40.

The comparator 51 is connected not only with the counter 50 but also with the output of a memory 70, from which fixed values can be called up. On the output side, a line 71 leads from the comparator 51 to the clock input of the flip-flop 65, to the second input of the NAND gate 64 and, via an inverter 72, to the second input of the NOR gate 63. Gate 63 is followed by the clock input of a flip-flop 74, the inverting output of which is both fed back to the input of the flip-flop 74 and coupled to the control input of the adder 55. The non-inverting output of the flip-flop 74 is coupled to the second input of the exclusive OR gate 61.

Preceding an enabling input of the counter 50 is a NAND gate 75, whose inputs are connected first to the output of the NAND gate 64 and second to the overflow output of the multiplier 77. This multiplier 77 can be exposed, via a first input 78, to a number and its counter input 79, is connected to the output of an AND gate 80. The input signals of the AND gate 80 are, in turn, a clock frequency signal and a signal from the non-inverting output of the flip-flop 32 (terminal point B). An indicator signal relating to closed-loop or open-loop operation can be picked up from the non-inverting output of the flip-flop 65, while the inverting output of this flip-flop 65 is connected with the AND gate 56 of the fuel metering circuit, between the multiplier 54 and the adder 55. This output commands AND 56 to pass the value of multiplier 54 to adder 55.

A command signal, dependent on the fuel-to-air ratio, is sent to adder 55. At this control input of the adder 55 it is ascertained whether the uncorrected injection signal arriving from the signal generator 53 and having the duration $t_i$ should be prolonged or curtailed. This means that the command signal from the flip-flop 74 swings between the values for an excessively rich and an excessively lean mixture.

Whether or not a correction takes place at all is determined by the control of the AND gate 56 between the multiplier 54 and the adder 55. In case of a malfunction this AND gate 56 has to block, so that the exhaust gas adjustment changes over to a corresponding control and the fuel metering then takes place dependent only on, for example, rpm and air throughput in the intake manifold.

The dimension of the positive or negative correction is ascertained by means of the output signal of the multiplier 54. This output signal is the product of the uncorrected injection time $t_i$—that is, its value in numbers, of course—and a command signal with a factor corresponding to the counter state of the counter 50. The counter state is continuously corrected in accordance with the sensor signal in that the counting direction of this up-down counter 50 and its counting process are controlled.

The counter state of the counter 50 corresponds in amount to the lambda displacement relative to lambda=1. The algebraic sign of the counting, based on a rich or a lean mixture, is stored in the flip-flop 74. The counter 50 is reset if there is a sensor failure, which is detected on the basis of the signal at the terminal point E. Counter 50 is provided with a "central reset", with which, especially at the outset of closed-loop control operation, definite output states can be initially established. In this case, a switchover is simultaneously made to open-loop control in a known manner not shown in the drawing of FIG. 2*b*.

The output signal of the differential amplifier 13 of FIG. 2*a*, in combination with the output signal of the flip-flop 74, determines the algebraic sign for the counter 50. With a positive signal at the non-inverting output and a lean mixture, or with a zero signal at the output of the flip-flop and a rich mixture, a logical 1 appears at the output of the exclusive OR gate 61, which causes upward counting in the counter 50. In the respective opposite cases, downward counting will take place. A counting process occurs only when there is a zero signal at the enabling input of the counter 50. This appears, however, only when the multiplier 77 emits an overflow signal and when the output signals of the comparator 51 and of the exclusive OR gate 61 are zero.

The multiplier 77 serves the purpose of adapting the counting frequency of the counter 50 to variables such as rpm and load which are specific for a certain engine. If necessary, this multiplier 77 is driven at only half the counting frequency, which occurs by means of the logical connection of the clock signal and the output signal of the flip-flop 32 (B). Only when a value below the lower threshold is present is the distinction between rich and lean made.

If a threshold of FIG. 1*a* is crossed, the exclusive OR gate 66 emits a logical 1 on the basis of the signal of FIG. 1*g*, as a result of which the content of the counter 50 is reduced in accordance with a displacement value (proportional component) which is set in adder 52.

With a zero signal at the output of the exclusive OR gate 61 and an output signal of the comparator 51 indicating identity of values, the flip-flop 74 (the rich-lean flip-flop) is switched over. The NAND gate 64, in combination with the NAND gate 75, acts as an overflow block for the counter 50. If there is identity of values in the comparator 51 and a positive counting direction, the counter stop will be considered as having been attained, and the entire system will be switched over from closed-loop control to open-loop control, via the flip-flop 65.

Mathematically, the output signal of the adder 55 can be expressed as follows:

$$t_{i'} = t_i + [\Delta\lambda] \cdot t_i \cdot \text{sign}$$

where "sign" is the algebraic sign of [the Q value of flipflop 74 minus 0.5]

(If Q=1, then "sign" is positive;
if Q=0, "sign" negative).

This means that the uncorrected injection time $t_i$ is corrected, with respect to the algebraic sign, in accordance with rich-lean operation and, with respect to amount, in accordance with the dimension of the lambda displacement.

Figure 3:
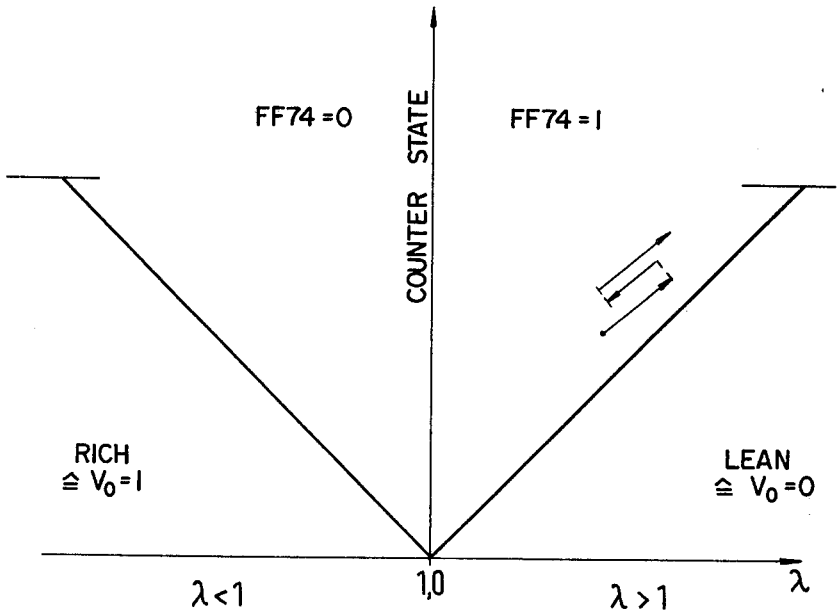
FIG. 3 is a schematic illustration to explain the counting course of a counter for forming the correction signal.

FIG. 3 illustrates the counter state of the up-down counter 50 in accordance with the lambda value; that is, in accordance with whether the mixture is rich or lean. The lambda value is plotted on the abscissa and the counter state is plotted on the ordinate. Upon attainment of the lambda value "one", the NOR gate 63, and thus the flip-flop 74 as well, switches over. It can be seen that the counter state of the counter 50, by itself, can furnish only an indication as to the amount of the lambda displacement, but cannot indicate anything as to its algebraic sign. A meandering line course in the right-hand half of the diagram is intended to indicate the continuous counting mode of the counter 50 (influence by the adder 52 is assumed to be excluded); it is clear that if there is a change in algebraic sign for the counting direction of the counter 50, no new outset values appear, which has a positive effect on the rapidity of the counting process.

The example described above of a fuel metering apparatus relates to a fuel injection system. Because the invention does not pertain to the injection system per se, it applies to fuel metering systems in general, such as controlled carburetor systems as well. What is essential is that a single threshold switch for the sensor signal is sufficient for the functioning of the apparatus, and both the direction and the amount of the fuel metering are corrected in accordance with the output signal of this threshold switch.

The exemplary embodiment discussed illustrates one possible realization using conventional digital components. It is of course equally possible for the subject to be realized as well with a computer, with appropriate programming oriented toward the mode of operation of the circuit shown in FIG. 2.

Previously it was conventional to determine the mixture composition on the basis of the appearance of individual components in the exhaust gas of the engine. It has been demonstrated, however, that the reaction time of such control systems can be substantially improved if the mixture is catalytically combusted while it is still in the intake manifold of the engine and when the closed-loop control operation functions in accordance with the final components resulting from this combustion process.

The foregoing relates to a preferred exemplary embodiment of the invention, it being understood that other embodiments and variants thereof are possible within the spirit and scope of the invention, the latter being defined by the appended claims.

What is claimed is:

1. A fuel metering apparatus in an internal combustion engine, having a clocking means to provide clock pulses, a sensor for detecting a component of the mixture composition and generating a signal indicative thereof; a control circuit connected to the sensor for generating command signals dependent on the mixture component; a fuel metering circuit connected to the control circuit, wherein the output of the fuel metering circuit is corrected according to the command signals; wherein the control circuit has a single threshold switch that is connected to the clock clocking means and is alternated between a pair of threshold levels as a function of the clock pulses and wherein the control circuit includes a memory having a value stored therein, such that the value is altered in accordance with the dwell time of the sensor signal between predetermined levels.

2. A fuel metering apparatus in an internal combustion engine, having a clocking means to provide clock pulses, a sensor for detecting a component of exhaust gas composition and generating a signal indicative thereof; a control circuit connected to the sensor for generating command signals dependent on the exhaust gas component; a fuel metering circuit connected to the control circuit, wherein the output of the fuel metering circuit is corrected according to the command signals; wherein the control circuit has a single threshold switch that is connected to the clocking means and is alternated between a pair of threshold levels as a function of the clock pulses and wherein the control circuit includes a memory having a value stored therein, such that the value is altered in accordance with the dwell time of the sensor signal between predetermined levels.

3. A fuel metering apparatus as defined by claim 1, wherein the threshold switch alternates at a constant frequency.

4. A fuel metering apparatus as defined by claim 1, wherein the memory is a counter.

5. A fuel metering apparatus as defined by claim 1, wherein the control circuit comprises a first logic gate, the input of which is connected to receive the output of the threshold switch and the clock pulses.

6. A fuel metering apparatus as defined by claim 5, wherein the first logic gate is an OR gate.

7. A fuel metering apparatus as defined by claim 1, wherein the control circuit comprises an up-down counter, having a stored value, and wherein the up-down counter is connected to the threshold switch, such that the counting direction of the up-down counter is determined by the threshold switch output.

8. A fuel metering apparatus as defined by claim 7, wherein the up-down counter is connected to the fuel metering circuit such that the stored value of the up-down counter is generated as a command signal to the fuel metering circuit.

9. A fuel metering apparatus as defined in claim 8, wherein the control circuit comprises a second logic gate and a flip-flop such that the second logic gate is connected to the up-down counter to control the counting direction of the up-down counter.

10. A fuel metering apparatus as defined in claim 9, wherein the second logic gate is connected to and receives signals from the flip-flop and the threshold switch such that the second logic gate produces an output as a function of the signals from the threshold switch and the second logic gate.

11. A fuel metering apparatus as defined by claim 1, wherein the output of the fuel metering circuit occurs multiplicatively and additively in accordance with the equation $$t_i(\lambda)=t_i+[\Delta\lambda]\cdot t_i\cdot\text{sign}$$

where "sign" is the algebraic sign of and where $t_i$ is injection time of the fuel metering apparatus, and $\lambda$ is oxygen content of the mixture composition.

12. A fuel metering apparatus as defined by claim 2, wherein the threshold switch alternates at a constant frequency.

13. A fuel metering apparatus as defined by claim 2, wherein the memory is a counter.

14. A fuel metering apparatus as defined by claim 2, wherein the control circuit comprises a first logic gate, the input of which is connected to receive the output of the threshold switch and the clock pulses.

15. A fuel metering apparatus as defined by claim 14, wherein the first logic gate is an OR gate.

16. A fuel metering apparatus as defined by claim 2, wherein the control circuit comprises an up-down counter, having a stored value, and wherein the up-down counter is connected to the threshold switch, such that the counting direction of the up-down counter is determined by the threshold switch output.

17. A fuel metering apparatus as defined by claim 16, wherein the up-down counter is connected to the fuel metering circuit such that the stored value of the up-down counter is generated as a command signal to the fuel metering circuit.

18. A fuel metering apparatus as defined in claim 17, wherein the control circuit comprises a second logic gate and a flip-flop such that the second logic gate is connected to the up-down counter to control the counting direction of the up-down counter.

19. A fuel metering apparatus as defined in claim 18, wherein the second logic gate is connected to and receives signals from the flip-flop and the threshold switch such that the second logic gate produces an output as a function of the signals from the threshold switch and the second logic gate.

20. A fuel metering apparatus as defined by claim 2, wherein the output of the fuel metering circuit occurs multiplicatively and additively in accordance with the equation $$t_i(\lambda)=t_i+[\Delta\lambda]\cdot t_i\cdot\text{sign}$$

where "sign" is the algebraic sign of and where $t_i$ is injection time of the fuel metering apparatus, and $\lambda$ is oxygen content of the exhaust gas composition.

* * * * *